United States Patent [19]

Gunn-Smith

[11] 4,148,416

[45] Apr. 10, 1979

[54] AEROSOL CONTAINERS

[75] Inventor: Ronald A. Gunn-Smith, Hampton Court, England

[73] Assignee: Metal Box Limited, Reading, England

[21] Appl. No.: 823,734

[22] Filed: Aug. 11, 1977

[30] Foreign Application Priority Data

Aug. 20, 1976 [GB] United Kingdom ..... 34722/76

[51] Int. Cl.[2] ..... B65D 83/14

[52] U.S. Cl. ..... 222/94; 222/95; 222/564

[58] Field of Search ..... 222/386.5, 94, 464, 222/211, 95, 212, 215, 564

[56] References Cited

U.S. PATENT DOCUMENTS

| | | | |
|---|---|---|---|
| 3,257,036 | 6/1966 | Micallef | 222/464 X |
| 3,718,236 | 2/1973 | Reyner et al. | 222/386.5 |
| 3,788,521 | 1/1974 | Laauwe | 222/94 |
| 3,876,115 | 4/1975 | Venus et al. | 222/386.5 X |
| 4,013,195 | 3/1977 | Ferris | 222/386.5 X |
| 4,062,475 | 12/1977 | Harris et al. | 222/386.5 X |

*Primary Examiner*—John P. Shannon

*Attorney, Agent, or Firm*—Diller, Ramik & Wight

[57] ABSTRACT

In an aerosol dispensing container of the kind having a collapsible bag separating the propellant from the product to be dispensed, an elongate core member is arranged completely free, loose and unattached within the bag to prevent pockets of product becoming isolated from the dispensing valve when the bag collapses. The core member provides a path, unaffected by bag collapse, for the product to pass to the valve.

10 Claims, 11 Drawing Figures

AEROSOL CONTAINERS

This invention relates to aerosol dispensing containers of the kind in which the product to be dispensed is contained in a product chamber defined by the interior of a collapsible bag within the aerosol container body. The container is pressurised by propellant in a propellant chamber between the body and the bag but outside the latter, so that actuation of a dispensing means, typically a valve, on the top of the container allows dispensing of the product as the bag is collapsed by the external pressure of the propellant. Such aerosol dispensing containers, hereinafter to be referred to as "bag-in-can aerosol dispensing containers", have advantage over the more conventional aerosol dispensing containers in that the product is at all time held out of contact with the propellant so as to be substantially free from contamination thereby. Moreover, the propellant is not vented to atmosphere during use. In the case of corrosive products, furthermore, contact with the container body is denied.

One difficulty met with bag-in-can aerosol dispensing containers is that the bag may collapse in such a way as permanently to trap a substantial proportion (e.g. 20%) of the product, usually at the bottom end of the bag, that is to say, the end of the bag remote from the valve. A possible mode of entrapment arises when the bag becomes folded over on itself. To overcome this problem pleated bags have been proposed, the folds of which progressively collapse in a controlled manner as product dispensing progresses. However, such bags are expensive to manufacture, and a primary object of the invention is to provide a bag-in-can aerosol dispensing container which may utilise a conventional bag (i.e. one having no special provision for ensuring controlled collapse) but from which product strangulation as described above is wholly or substantially precluded with little additional cost in material or labour charges.

Accordingly, from one aspect, the invention provides a bag-in-can aerosol container having an elongate core member loosely disposed within the bag, or attached to a part of the container such as the dispensing means, so as to extend generally longitudinally in the product chamber and arranged to allow product to pass along for dispensing, despite constriction of the bag.

Desirably, the elongate member is of hollow tubular form so as to pass the product internally. Alternatively, however, the member may be solid but shaped so as with the collapsed bag wall to define a single external channel, or a plurality of external channels therealong for passage of the product. It may be rigid, or it may be flexible so as to be able to conform to a symmetrical deformation of the bag; and it may have perforations in its side wall.

In order that the invention may be more fully understood various embodiments thereof will now be described by way of example, with reference to the accompanying drawings, in which.

Figure 1:
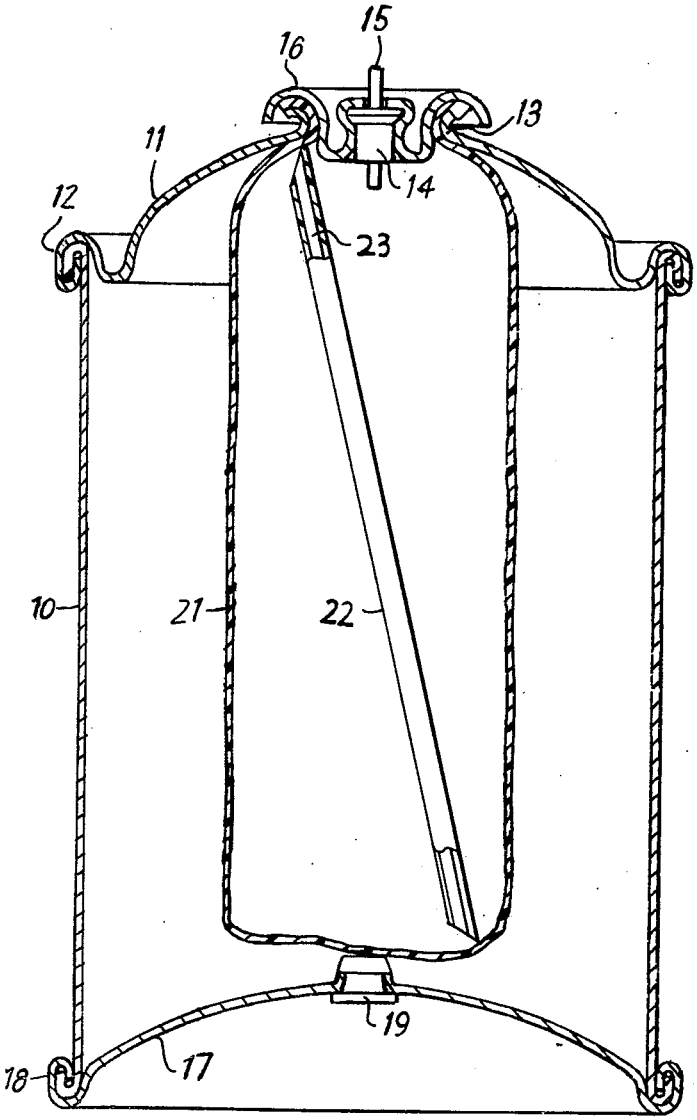
FIG. 1 shows in central vertical section, a bag-in-can aerosol container in a first embodiment of the invention, having a loose unperforated tube.

Referring firstly to FIG. 1, a bag-in-can aerosol container has a cylindrical body portion 10 having a valve mounting cone 11 peripherally seamed by a conventional double seam at 12 to its top end as shown. The cone 11 is centrally formed with an aperture defined by an out-turned curl 13, and a dispensing valve 14 having a projecting actuating stem 15 is mounted within the aperture by crimped attachment of the curled periphery of a mounting cup 16 to this curl 13. In known manner the valve 14 is actuable by depression of a nozzle member (not shown) on the stem to allow product within the container to be dispensed under pressure as is later described.

The body portion 10 is closed at its bottom end by a domed end closure 17 which is seamed to the body portion at 18 and has a central aperture closed by a removable bung 19. The body portion 10, the mounting cone 11 and the end closure 17 are assembled to form the body or "can" of the bag-in-can aerosol container.

A flexible bag 21 of plastics material is disposed within the can with the free edge at its open top end trapped in the interface between the mounting cup 16 and the mounting cone 11. Alternatively it may be held within the double seam 12. The bag thereby provides, in use, a substantially impermeable barrier separating the contents of the bag, i.e. product to be dispensed as an aerosol, within it from propellant located within the can but outside the bag.

The container as described above may be considered as conventional. As such, it is but one example. The "can" may in fact be any suitable container body, of metal, plastics, glass or any other suitable material, and may be made in one piece or may consist of two pieces or of more than three, not merely of three pieces as in this example. The bag may be of any suitable design and may be attached in any practicable manner to the container. The product may be any product which it is required shall be dispensed in aerosol form; and any suitable propellant may be used.

The bung 19 may be made irremovable in known manner. Alternatively, the bung 19 may be omitted; in which connection, the method of injecting propellant into the container and product into the bag may be any suitable method and does not form any part of the present invention.

The container in the present example differs from prior art arrangments in the provision of an elongate member, comprising a tube 22, within the bag 21. The tube 22 may advantageously be of plastics dip tubing, substantially rigid, as normally used for aerosol containers of the more conventional kind, that is, in which the propellant and aerosol product are in contact. It is particularly to be noted that, in this example, the tube 22 is unconnected to any other part of the container; it lies loosely within the bag. However, the length of the tube 22 is such that it is constrained to adopt a generally vertical attitude, so that it lies generally longitudinally within the bag.

In one method of manufacture of the filled container the packer receives the can with the valve aperture in the top end cone 11, defined by the curl 13, open. The packer places the bag 21 in position through the valve aperture, fills it with product, places the mounting cup 16, with valve 14 already attached, into position on the curl 13, and then swages the mounting cup periphery on to the curl 13 to form a gas-tight and liquid-tight seal incorporating the free edge of the bag. In alternative methods, using cans or other equivalent container bodies of one, two or more components, the packer may receive the container body or can with the bag already placed in position, in which case it may or may not have been secured to the container body. The packer may even receive the whole container complete but empty, in which case he will introduce product into the bag by any suitable method, such as through or past the valve 14 in known manner.

The container is completed in the example shown in FIG. 1, by pressurising the can with propellant through the central aperture in the end closure 17, and then closing the aperture with the bung 19.

The tube 22 is introduced into the bag after the latter has been inserted within the can but before the mounting cup 16 is placed in position. It may be added before or after the product is introduced.

For operation, the user depresses the nozzle member of the valve stem 15 to open the valve and allow aerosol product from within the bag to pass along the stem to the nozzle member for dispensing. The aerosol product is pressurised by the propellant acting against the bag wall. As the product is progressively dispensed the bag correspondingly collapses in a largely uncontrolled manner. However, the possibility of the bag completely collapsing part way along its length and so trapping a substantial proportion of the product at the bottom of the bag, in isolation from the valve 14, is prevented by the tube 22, the bore 23 of which provides a passage at all times communicating together the bottom and top ends of the bag interior. As shown at 24, the ends of the tube 22 are preferably cut on an angle to reduce any tendency for the tubing to be closed off by the bag during dispensing. Alternatively or additionally, the tubing may be perforated by one or more holes or slits; these may be restricted to the bottom end of the tubing or to the top end of the tubing, or, if desired, they may be provided along the whole length of the tubing. The latter arrangement has the advantage that it prevents the possibility of product residues being left part way up the bag by multiple strangulation of the latter.

Figures 3, 4:
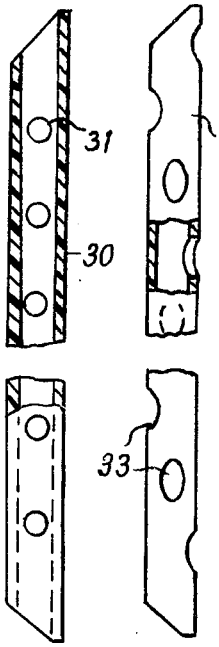
FIGS. 3 to 6 are part-sectional fragmentary elevations showing portions of various forms of perforated tube which can be used in modified embodiments of the invention.
Figure 5:
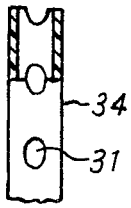
Figure 6:
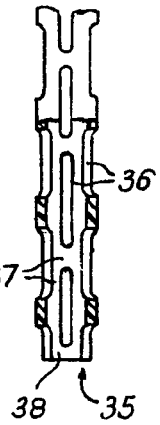

FIGS. 3 to 6 show but a few examples of the numerous possible forms of perforated tube suitable for use, in place of the tube 22, loose in the bag 21. The tube 30 in FIG. 3 is similar to tube 22 but has two diametrically-opposed lines of perforations 31 along its length. The tube 32 in FIG. 4 is the same except that the perforations 33 are larger and are arranged on a helix. The tube 34 in FIG. 5 is similar to the tube 30 but, instead of its end being cut on an angle, it is cut transversely across one of the perforations 31, the latter providing a means of exit for product (or, at the other end, not shown, a means of entry). The tube 35 in FIG. 6 has a large number of slots 36 separated by relatively narrow webs 37. The tube 35 is merely an example of what is in effect a lattice-like frame structure permitting easy entry of product into its bore 38 along its whole length.

Figure 2:
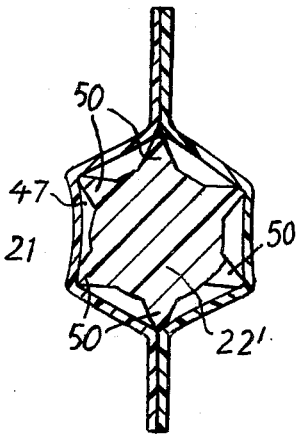
FIG. 2 shows a detail of part of the container when in use, in a second embodiment of the invention having a solid profiled rod.

In the modification depicted in FIG. 2, the loose tube 22 of FIG. 1 is replaced by a loose solid elongate rod 22', which is longitudinally ribbed at 50 so as in cross-section to have the form of a multipointed star. There may be any desired number of the ribs 50, which may be longitudinally extending as shown or, for example, helical. The rod ensures that even when the bag wall has fully collapsed as shown, aerosol product can still flow from the bottom end to the top end of the bag 21 via passages 47 which are defined between its ribs 50 underneath the bag material.

Figure 7:
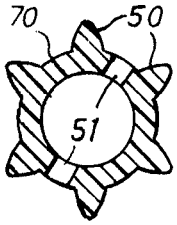
FIG. 7 is a cross-section on the line VII—VII, FIG. 8 showing a further modification, namely a profiled, perforated tube.
Figure 8:
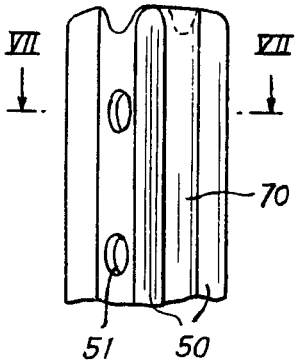
FIG. 8 is a fragmentary elevation on FIG. 7.

FIGS. 7 and 8 show a tube 70 formed with the ribs 50 and having, in addition, radial perforations 51. The ends, or either end, of the rod 22' or tube 70 may be formed on an angle like the tube 22, FIG. 1, or in any other way. In the case of the perforated, ribbed tube 70, this is shown in FIG. 8, by way of example only, formed with a blunt end intersecting a pair of the perforations 51, to provide an outlet for product from within the tube.

Figure 9:
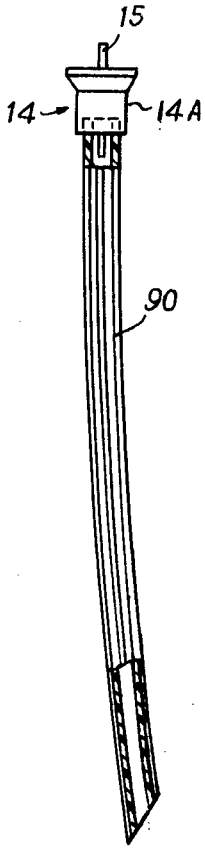
FIG. 9 is a part-sectional elevation showing an aerosol valve body having a profiled tube attached thereto in yet another embodiment of the invention.
Figure 11:
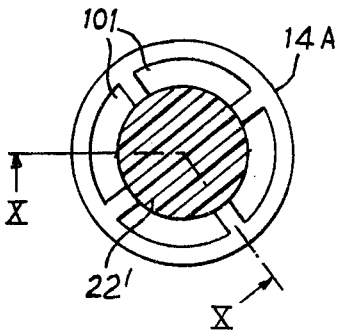
FIG. 11 is an inverted sectional plan on the line XI—XI in FIG. 10.
Figure 10:
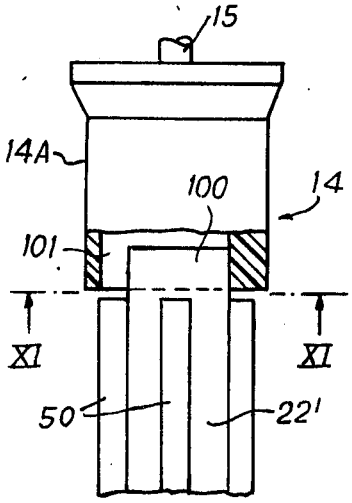
FIG. 10 is a part-sectional fragmentary elevation, taken on the line X—X in FIG. 11 and showing a modification to the arrangement of FIG. 9, namely use of a solid rod of the kind seen in FIG. 2, attached to the valve body.

The core member need not be loose in the bag as in all of the examples so far described, but may be attached to some other part of the container. In FIGS. 9 to 11, to be described shortly, core members are shown attached to the hollow housing or body 14A of the dispensing valve 14. Alternatively, means can be readily envisaged whereby a tubular core member may be attached to, or integral with, a top member of the container. For example, if the cup 16 or an equivalent member is of plastics material, a tubular core member such as the tube 35, FIG. 6, may be moulded integrally with it. In such a case the upper end of the tube may be flared outwards to its junction with that portion of the component that holds the valve 14, the latter being accommodated immediately above the flared portion.

Referring to FIG. 9, a ribbed tubular core member 90, is attached at its top end to the valve housing 14A. The member 90 is similar to the tube 70, FIG. 7, but without the perforations 51. However, the tube 70 may for example be substituted for the tube 90. The bottom of the housing 14A is perforated to allow entry of product passing up between the ribs 50 of the member 90 or 70. In FIGS. 10 and 11, the ribbed rod 22' of FIG. 2 is substituted for the tube 90 of FIG. 9. One method of attaching any core member to the valve housing is also illustrated, namely an end spigot 100 of the core member which is a force fit in the housing 14A, the latter having product inlet apertures 101 around the spigot.

It will be appreciated that any core member permitting entry of product along its length, e.g. any of those described except the unperforated tube 22 of FIG. 1, into an internal or external passage or duct of the core member at intermediate locations, may be attached to the housing of the dispensing valve, the top end of the core member being modified as necessary to fit the valve housing.

This inventin is not limited to the types of bag-in-can aerosol particularly described (which are shown only by way of example), but has substantially universal application to bag-in-can aerosol containers generally. It may thus be applied, not only to bag-in-can containers of the kind which have their bags attached at the junction between the valve mounting cup and the mounting cone, but also for example, to embodiments in which the bag is attached directly to the valve or to other parts of the can or other container body.

Although of particular value in association with bags of the type not arranged for controlled collapse, if desired the invention may be used in association with bags arranged for controlled collapsing.

I claim:

1. An aerosol dispensing container comprising a container body, a collapsible bag therein to separate a propellant chamber defined between the container body and the bag from a product chamber defined by the bag, actuable aerosol dispensing means carried by the container body and arranged in communication with the product chamber at a dispensing end of the bag remote from a bottom end of the bag, an elongate member within the bag extending for substantially the whole length of the bag, the elongted member having a top end adjacent said dispensing end and passage means adapted to allow product to pass at least from its end remote from the dispensing means into the vicinity of the dispensing means, despite constriction of the bag around the elongated member as product dispensing proceeds, wherein the improvement comprises the elongate member being completely free, loose and unattached within the bag, but having a length such that its top end is located at said dispensing end of the bag at all times during said constriction of the bag.

2. A container according to claim 1, wherein said passage means of the member are open to the outside of the member along its length, to permit product to enter the passage means intermediate between the ends of the member.

3. A container according to claim 1, wherein the member is tubular.

4. A container according to claim 2, wherein the member is tubular and has perforations through its wall intermediate between its ends.

5. A container according to claim 4, wherein the said perforations comprise slots.

6. A container according to claim 2, wherein the member has external ribs defining between them external ducts constituting at least part of said passage means.

7. A container according to claim 6, wherein said member is solid.

8. A container according to claim 6, wherein said member is tubular, having a bore constituting part of said passage means.

9. A container according to claim 8, wherein the member has perforations through its wall intermediate between its ends to connect the external ducts with the bore.

10. A container according to claim 1 wherein said actuable aerosol dispensing means includes a dispensing valve opening directly into said bag at its dispensing end adjacent said elongated member top end.

* * * * *